US007934281B2

(12) United States Patent
Bernardino et al.

(10) Patent No.: US 7,934,281 B2
(45) Date of Patent: May 3, 2011

(54) STAIN REMOVAL PROCESS CONTROL METHOD USING BPM MOTOR FEEDBACK

(75) Inventors: Flavio Erasmo Bernardino, St. Joseph, MI (US); Mary Ellen Zeitler, St. Joseph, MI (US); Dale E. Mueller, Benton Harbor, MI (US); Erik K. Farrington, St. Joseph, MI (US); Leon H. Spindler, Holland, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 991 days.

(21) Appl. No.: 11/273,207

(22) Filed: Nov. 14, 2005

(65) Prior Publication Data

US 2007/0107138 A1 May 17, 2007

(51) Int. Cl.
*D06F 35/00* (2006.01)
*D06F 39/00* (2006.01)

(52) U.S. Cl. ..... 8/159; 8/158

(58) Field of Classification Search ..... 68/12.6
See application file for complete search history.

(56) References Cited

U.S. PATENT DOCUMENTS

| | | | | |
|---|---|---|---|---|
| 4,097,307 | A * | 6/1978 | Geiger | 134/10 |
| 4,162,621 | A * | 7/1979 | Stone | 68/23.2 |
| 4,231,237 | A * | 11/1980 | Bochan | 68/23.7 |
| 4,481,786 | A * | 11/1984 | Bashark | 62/160 |
| 4,784,666 | A | 11/1988 | Brenner et al. | 8/137 |
| 4,987,627 | A | 1/1991 | Cur et al. | 8/158 |
| 5,219,270 | A | 6/1993 | Titmas | 415/80 |
| 5,219,370 | A * | 6/1993 | Farrington et al. | 8/158 |
| 5,345,156 | A | 9/1994 | Moreira | 318/254 |
| 5,507,053 | A * | 4/1996 | Mueller et al. | 8/158 |
| 5,890,247 | A * | 4/1999 | Erickson et al. | 8/158 |
| 6,269,666 | B1 | 8/2001 | Whah et al. | 68/12.02 |
| 6,393,872 | B2 * | 5/2002 | Whah et al. | 68/12.02 |
| 6,584,811 | B2 | 7/2003 | Whah et al. | 68/12.04 |
| 6,591,439 | B2 | 7/2003 | Whah et al. | 8/159 |
| 2001/0052249 | A1 * | 12/2001 | Whah et al. | 68/12.04 |
| 2003/0182975 | A1 * | 10/2003 | Tomigashi et al. | 68/12.04 |
| 2003/0208852 | A1 * | 11/2003 | Hardaway et al. | 8/158 |

FOREIGN PATENT DOCUMENTS

WO WO0029660 * 5/2000

* cited by examiner

*Primary Examiner* — Nicole Blan
(74) *Attorney, Agent, or Firm* — Clifton G. Green; Diederiks & Whitelaw PLC

(57) ABSTRACT

Methods for laundering a textile wash load in a washing apparatus comprising the steps of pre-treating a textile wash load using methods that include a detection step selected from an airlock detection step, a water log detection step and combinations thereof.

26 Claims, 5 Drawing Sheets

STAIN REMOVAL PROCESS CONTROL METHOD USING BPM MOTOR FEEDBACK

BACKGROUND OF THE INVENTION

1. Field of the Invention

This invention concerns an improved method for pretreating soiled clothing articles in an automatic washer.

2. Description of the Art

In order to improve the cleanability of clothing articles in automatic washers, consumers routinely apply pretreating solutions such as detergents and clean enhancing agents to clothing articles before they are placed into automatic washers. These products and procedures generally require that a pretreating chemical separate and distinct from the detergent solution used in the automatic washer be applied to a clothing article and that the pretreating chemical is allowed to remain in contact with the clothing article for a period of time before the clothing article is placed in an automatic washer.

Manufacturers of automatic washers have attempted to assist consumers by incorporating pretreatment steps into preprogrammed automatic washer processes in order to eliminate the need for consumers to manually pretreat clothing articles. Stain treatment processes based on spin and spray treatment of fabrics during the wash cycle are known. There are a number of patents describing variations of this type of process. There are also a number of automatic washers on the market that are capable of performing clothing pretreatment steps. In general, the patents and automatic washers attempt to either reduce the amount of detergent solution used to saturate the textile wash load by increasing the detergent concentration or they attempt to solve suds lock issues which arises as a result of the use of low liquid volume/high detergent concentration solutions in automatic washer pretreatment processes.

U.S. Pat. Nos. 5,507,053 and 5,219,270 disclose automatic washers that disclose stain pretreatment apparatuses or methods. Suds lock issues caused by stain removal processes are disclosed for example in U.S. Pat. Nos. 6,591,439, 6,584,811, 6,393,872, 6,269,666, 4,784,666 and 4,987,627. The specifications of each of these eight patents are incorporated herein by reference.

Using small volumes of concentrated washing solutions improves wash load clean efficiency. However, since wash load size can vary, there is a risk that the concentrated washing solutions will be entirely absorbed onto the wash load used creating suds lock. There is also a risk that too much water will be used to dilute the concentrated washing solutions thereby reducing cleaning efficiencies. Despite the variety of automatic washer pretreatment methods and apparatuses currently available, there remains a need for improved washing processes and methods that are able to use small volumes of concentrated washing solutions.

SUMMARY OF THE INVENTION

One aspect of this invention are methods for controlling concentrated washing solution volumes independently of the size of the wash load in order to improve the cleaning performance of automatic washing machines.

Another aspect of this invention is a method for laundering a textile wash load in a washing apparatus comprising the steps of: loading a textile wash load into a washer basket of the washing apparatus wherein the washer basket is surrounded by a stationary washer tub; introducing a volume of concentrated detergent solution into the washer tub; applying at least a portion of the concentrated detergent solution to the textile wash load; rotating the washer basket relative to the stationary washer tub; and performing detection step selected from the group consisting of an air lock detection step, a water log detection step and both an air lock detection step and water log detection step.

DESCRIPTION OF THE CURRENT EMBODIMENT

The present invention consists of improved automatic washer spin and spray treatment processes. The spin and spray treatment processes of this invention are useful for improving textile cleaning performance by applying concentrated washing solutions such as concentrated detergent, fabric softening, and bleach solutions to textile wash loads of all sizes. An important consideration in improving textile cleaning performance is the use of small volumes of concentrated washing solutions because the amount and type of textiles located in the automatic wash system vary greatly, the capacity of the wash load to absorb liquids can also vary greatly. The processes of this invention are able to control the volume of concentrated washing solutions used in spin and spray treatment processes independently of textile wash load type or size in a manner that improves textile cleaning performance.

The processes of this invention uses one or more detection steps selected from the group consisting of a water log detection step, an airlock detection step or both detection steps to evaluate whether or not a selected textile wash load treatment procedure is proceeding acceptably. The use of one or both of these detection steps provides feedback necessary for the washing algorithm to determine whether textile wash load treatment is proceeding normally, completed and if not proceeding normally, implementing procedure(s) that will maximize the textile wash cleaning performance.

Figure 1:
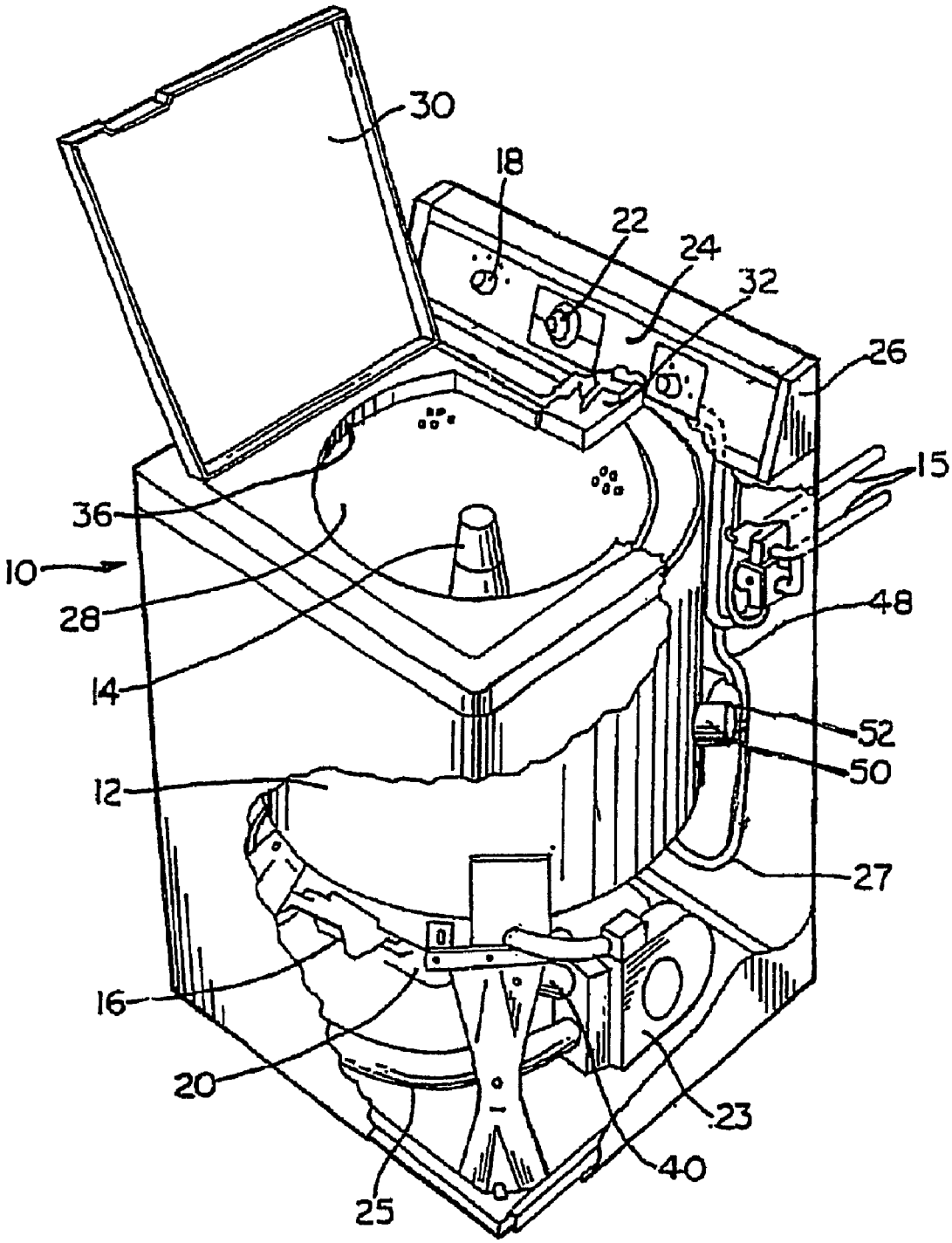
FIG. 1 is a perspective view of a partially cut away automatic washer that includes features capable of performing embodiments of the methods of this invention.

A washing machine 10 is generally shown in FIG. 1. Washing machine 10 includes a wash tub 12 with a vertical agitator 14 therein, a water supply 15, and a power supply (not shown). An electrically driven motor 16 is operably connected via a transmission 20 to the agitator 14 and to wash basket 28. Controls 18 include a presettable sequential control device 22 for use in selectively operating the washing machine 10 through a programmed sequence of steps. The treatment process algorithms disclosed herein may be programmed into control device 22. An optional water level setting control 18 is provided for use in conjunction with control device 22. A fully electronic control having an electronic display (not shown) may be substituted for control device 22. The control device 22 is mounted to a panel 24 of a console 26 on the washing machine 10. A rotatable and perforate wash basket 28 is carried within wash tub 12 and has an opening 36 which is accessible through an openable top lid 30 of the washer 10.

A sump hose 40 is fluidly connected to a sump (not shown) contained in a lower portion of tub 12 for providing a fluid recirculating source. Recirculating fluid exits the sump via recirculating spray nozzle hose 48 which is fluidly connected to recirculating spray nozzle 32. An optional air dome 50 having a deepfill pressure sensor or transducer may be used to provide a pressure signal indicating when a minimum detectable amount of liquid is present in wash tub 12.

The process of this invention will be discussed in the context of its operation in a vertical axis automatic washing machine as shown in several of the figures. However, the processes of this invention are equally applicable to horizontal or tilted axis washing machines. Moreover, the processes of this invention may be practiced in a variety of machines which may include, for example, different motor and transmission arrangements, pumps, recirculation arrangements, agitators, impellers, wash baskets, wash tubs, or controls so long as the arrangements are capable of accomplishing the processes of this invention.

Figure 2:
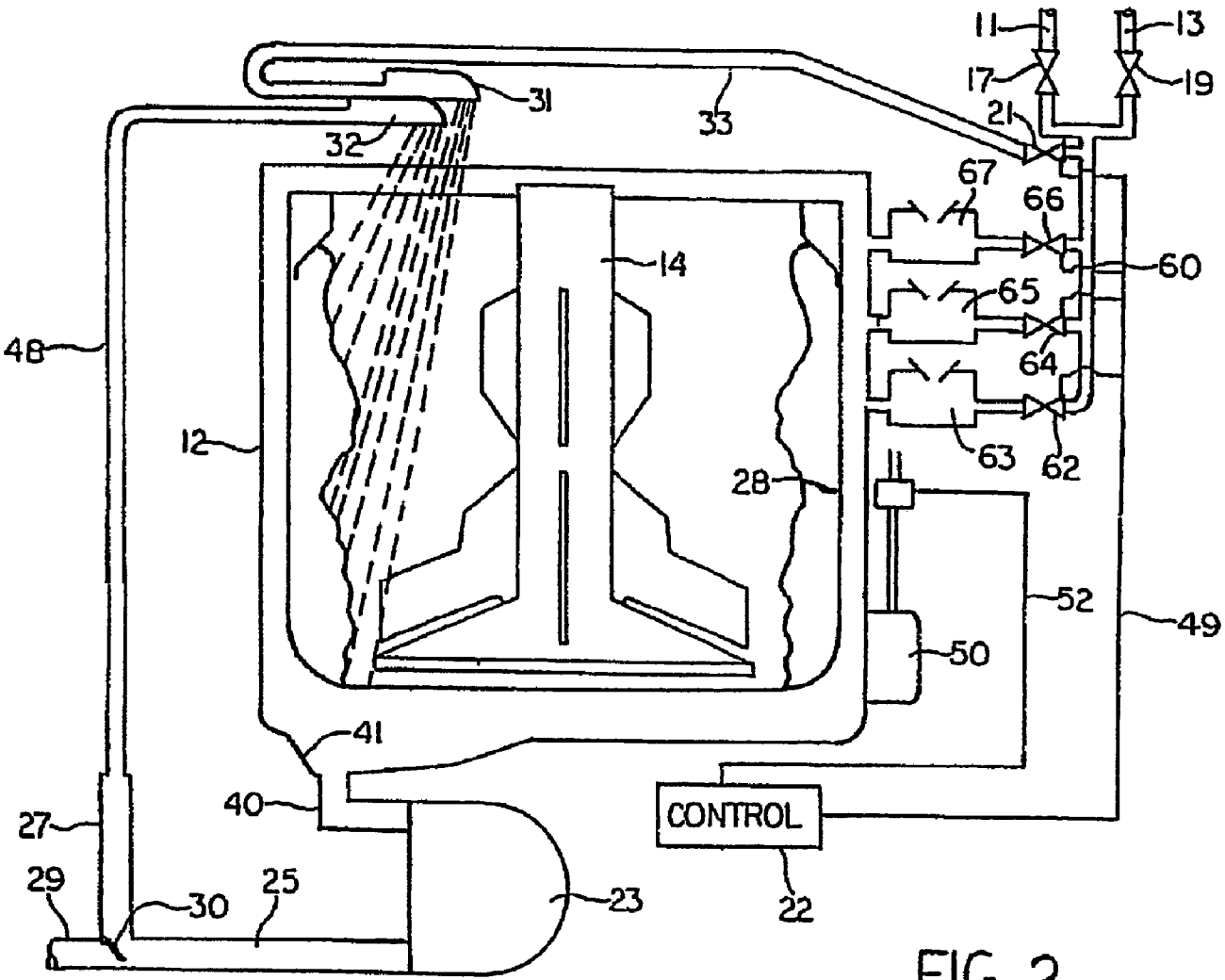
FIG. 2 is a diagram of an automatic washer that is useful for performing embodiments of the methods of this invention.

FIG. 2 is a schematic diagram of a washing machine useful for performing methods of the present invention. Hot water inlet 11 and cold water inlet 13 are controlled by hot water valve 17 and cold water valve 19, respectively. Valves 17 and 19 are selectably openable to provide fresh water to feed line 60. A spray nozzle valve 21 is fluidly connected to feed line 60 for selectably providing fresh water to tub 12 when desired. This fresh water is delivered by fresh water spray nozzle 31 via fresh water hose 33. Valves 17 and 19 are openable individually or together to provide a mix of hot and cold water to a selected temperature.

Upon opening one or both of valves 17 and 19, fresh water is selectably provided to a series of dispenser valves via feed line 60. Valve 62 selectably directs fresh water into detergent dispenser 63. When fresh water is directed to detergent dispenser 63, it flows through dispenser 63 and into wash tub 12 thereby bypassing wash basket 28. Valve 64 selectably provides fresh water to bleach dispenser 65, and valve 66 selectably provides fresh water to softening agent dispenser 67.

The washing machine of FIG. 2 further includes a liquid recirculation system. In order to recirculate liquid, tub sump 41 collects liquid at the bottom of wash tub 12 and is fluidly connected to pump 23 by sump hose 40. For purposes of this invention, the term "wash liquid" refers to any liquid that is recirculated during operation of the washing machine, including, but not limited to any chemical solution concentrated or otherwise, rinse solutions, and so forth. Pump 23 is selectably operational to pump liquid from wash tub sump 41 via pump outlet hose 25 either to recirculating hose 27 or drain hose 29 depending on the position of bidirectional valve 30. Alternatively, two pumps can be used to pump liquid from a tub sump 41. In a two pump system, one pump would be used to recirculate liquid from wash tub sump 41 to wash basket 28 and a second pump would be used to direct liquid from wash tub sump to a drain via drain hose 29. Recirculating hose 27 directs recirculating wash liquid to recirculating spray nozzle 32 via recirculating spray nozzle hose 48 where it is directed towards the textile wash load located in wash basket 28.

Control 22 receives a static pressure signal from deepfill transducer dome 50 via lines 52 for signaling the level of wash liquid within wash tub 12 including signaling when a minimum detectable liquid level is reached, however the invention disclosed herein may be practiced using a liquid detection device other than a deepfill pressure dome. Control 22 is further operable to send signals via lines 49 to valves 21, 62, 64 and 66 in order to control on and off times for these valves.

The textile laundering methods of this invention, several embodiments which are described below, each involve the use of at least one detection selected from an airlock detection step, a water log detection step and a combination of one or more airlock and one or more water log detection steps to provide feedback to controller 22 about the status of the laundering method. The "airlock detection step" refers to a step to detect whether pump 23 is pumping liquid or air/foam. When pump 23 is pumping air or foam, the undesirable condition is referred to as suds lock. This condition occurs when most to all of the available solution in wash tub 12 and accompanying sump 41 has been applied to a textile wash load located in wash basket 28 and essentially no solution remains at the pump inlet. The airlock detection step is performed by monitoring feedback from a motor that is used to drive pump 23.

The presence of suds lock in an airlock detection step indicates that the minimal wash solution volume required in the processes of this invention is not present in the system. In this situation, the control algorithm will be programmed to increase the water level by either adding liquid into the automatic washer or by attempting to extract additional liquids from the textile wash load. These methods for increasing the wash tub water level are discussed in more detail below.

A second detection method useful in the processes of this invention is a "water log detection step". The water log detection step is useful for detecting whether or not wash tub 12 includes an excess concentrated washing solution. When wash tub 12 includes excess solution, the solution level rises to the height of wash tub 28 where it impinges on the rotation of wash basket 28. One method for detecting water log is to measure a feedback feature of a motor that is used to rotate wash basket 28 in order to identify the occurrence of wash basket drag. The detection of water log indicates that, at the time of detection, the automatic washer includes a sufficient liquid volume to perform the ongoing spin and spray treatment processes and that no additional solution is required by the ongoing procedures.

Suds locks and airlock may be detected by any method able to identify when pump 23 is pumping liquid or air/foam and when wash basket 28 rotation is impinged by excess water in wash tub 12. A preferred method of detecting suds lock and airlock is to monitor a characteristic of the motor used to drive pump 23 and the motor used to rotate wash basket 28 that is indicative of suds lock and/or water log. The type of motor used to drive pump 23 and wash basket 28 is not critical to this invention so long as a characteristic of the motor can be monitored to identify suds lock and/or water log. For example, electric motors can be used to drive pump 23 and/or rotate wash basket 28. If an electric motor is used, then a tachometer may be placed on the motor driving pump 23 to identify when the pump 23 motor speed increases (indicating the presence of suds lock) or a tachometer can be placed on the wash basket to identify when the wash basket motor speed decreases (indicating the presence of water log). Alternatively, the current draw of an electric motor is a characteristic that may be monitored to identify when the pump 23 motor current draw decreases (indicating suds lock) or when wash basket drive motor current draw increases (indicating water log).

In another embodiment, a brushless permanent magnetic (BPM) motor may be used to drive either pump 23 and/or rotate wash basket 28. Any characteristic of a BPM motor that that is perceptibly different depending upon whether pump 23 is pumping liquid or air/foam may be monitored to identify an airlock situation. Examples of BMP motor characteristics that may be monitored include the operating speed. U.S. Pat. No. 5,345,156, the specification is which is incorporated herein by reference in its entirety, discloses methods for sensing the operating speed of a BPM motor. Other process characteristics that may be monitored include, but are not limited to the speed of the pump or wash basket relative to the expected speed, the BPM motor current draw, and the pulse width modulation duty cycle.

Wash basket motor characteristic monitored to detect water log may be the same characteristic(s) monitored in conjunction with the airlock detection step. BPM motor may also be used to rotate wash basket 28. BPM motor characteristics that can be monitored to identify water log include, for example, the speed of the wash basket BPM motor where a drop in the motor speed (RPMs) will generally indicate the presence of water log. Any other motor characteristics and/or wash basket characteristic that are perceptibly different when wash basket drag is present and absent are characteristics that can be monitored and detected in the present invention in order to identify the presence of wash basket drag and water log.

Figure 3:
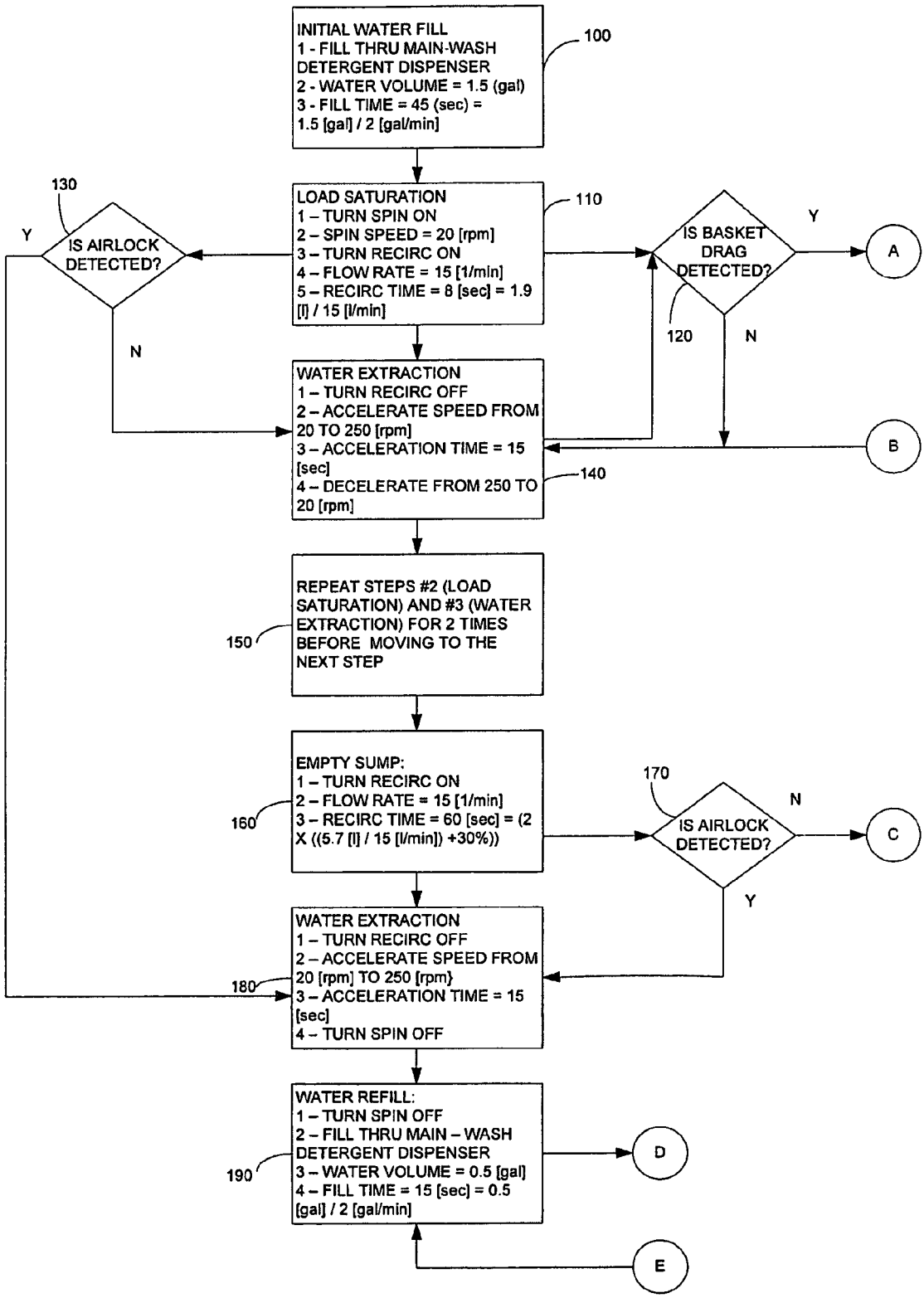
FIG. 3 is a block diagram of a portion of a process embodiment for controlling water level and preventing sudslock during the execution of a spin and spray stain treatment process.
Figure 4:
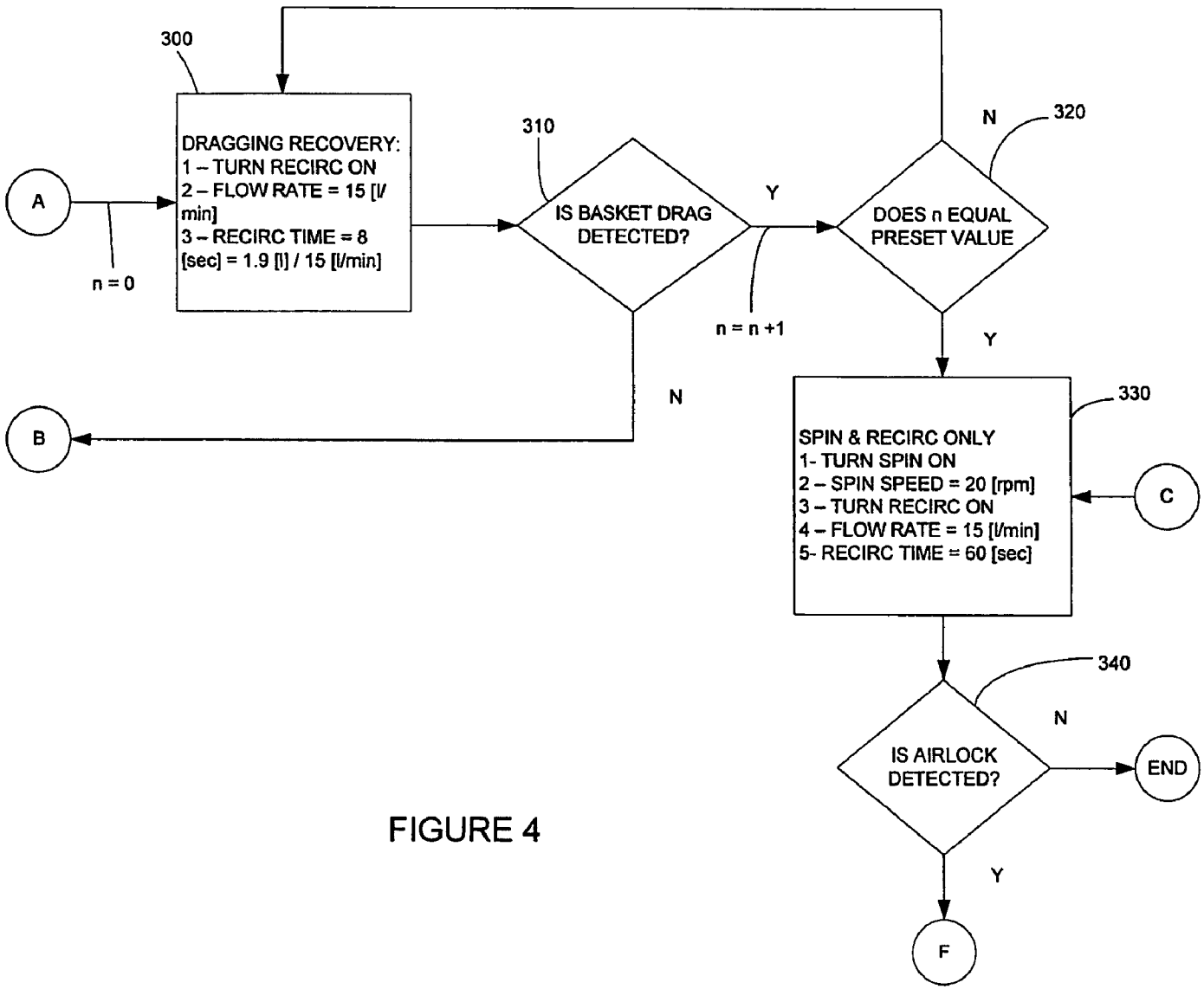
FIG. 4 is a block diagram continuing the process embodiments of FIG. 3.
Figure 5:
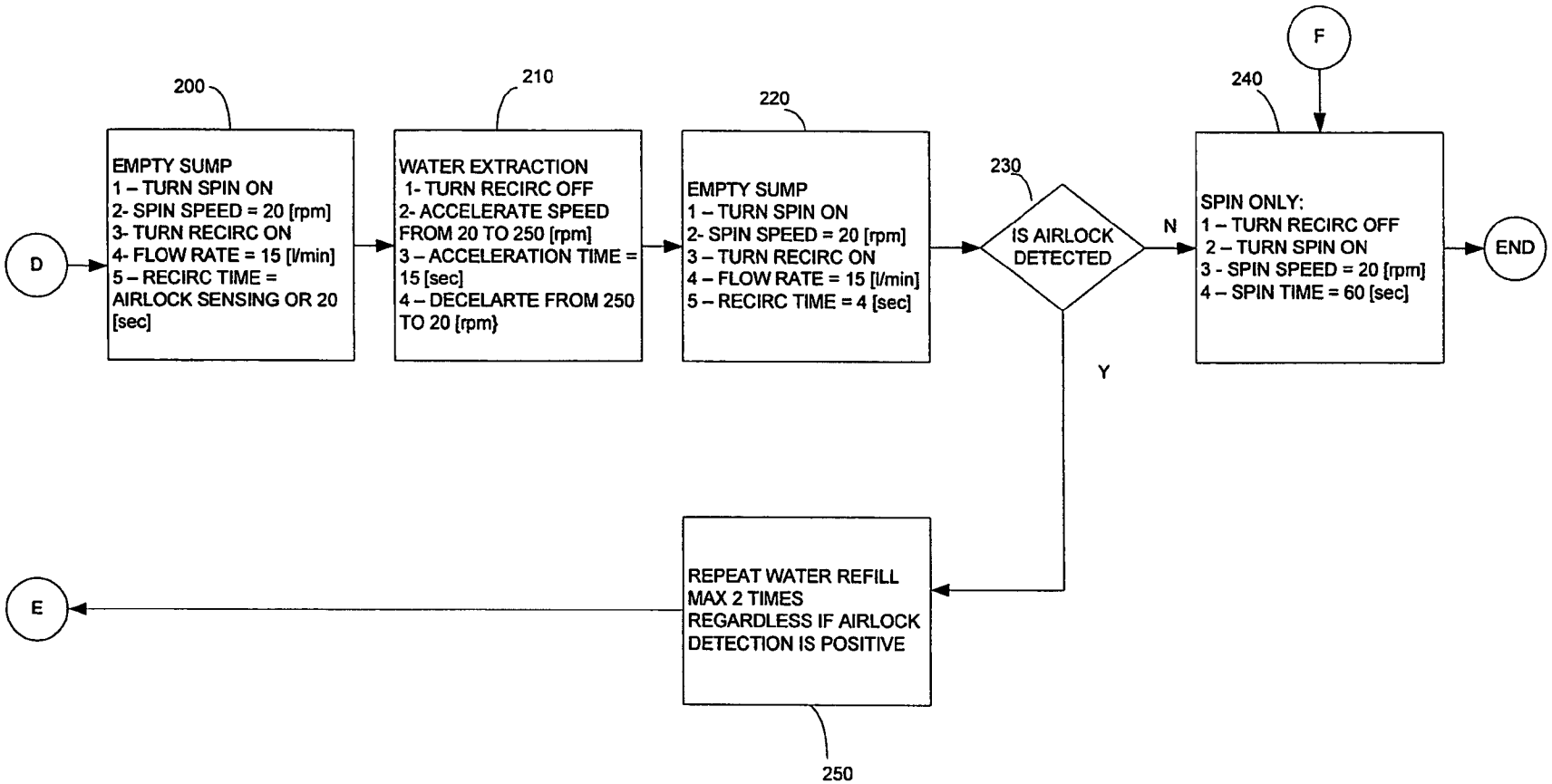
FIG. 5 is a block diagram continuing the process embodiments of FIGS. 3.

FIGS. 3-5 are of block diagrams of process embodiments of this invention. The processes embodied in FIGS. 3-5 are useful generally for performing various textile wash load treatment methods including clothing treatment or pretreatment with concentrated chemical solutions such as, but not limited to detergent solutions, bleach solutions, and fabric softener and other useful textile cleaning and treatment chemicals. The process embodiment depicted in FIGS. 3-5 and discussed in more detail below related to a textile wash load detergent pretreatment process. However, as indicated above, the methods of this invention are equally applicable to alternative clothing treatment methods, the implementation of which would be apparent to one of ordinary skill in the art.

In step 100 of FIG. 3, a textile wash load is placed in wash tub 28 of an automatic washing machine. The automatic washing machine is filled with an initial volume of concentrated detergent solution. The concentrated detergent solution will generally comprise a detergent or equivalent pretreating agent that is combined with a small volume of fresh water. In one embodiment, the chemical solution is located in wash tub 12 without contacting the textile wash load. In one method of this embodiment, a chemical solution can be poured into wash basket 28 by the consumer and it can fall through perforations in the bottom of wash basket 28 and into wash tub 12. The fresh water can similarly be directed into wash tub 12 via wash basket 28. In another method, a chemical solution such as a detergent can be poured into a chemical dispenser such as detergent dispenser 63 where it flows directly into wash tub 12 without contacting the textile wash load. Fresh water can similarly be added to wash tub 12 through detergent dispenser 63 of any other dispenser by opening valve 62. However, any method known in the art for placing a chemical solution and fresh water in wash tub 12 may be utilized in this step.

A predetermined amount of fresh water is added to the detergent to form a concentrated detergent solution. The predetermined volume of fresh waster may be established by a number of different methods. In one method, the predetermined volume of fresh water may be determined by a flow meter associated with the automatic washer controls. In another embodiment, liquid level controls may be used to establish one or more measurement points to identify when the washer involves predetermined volume of fresh water.

In the yet another method, fresh water valve may be open for a predetermined period of time sufficient to allow a known and small volume of fresh water to enter wash tub 12 where it can combine with a detergent to form a concentrated detergent solution. The volume of concentrated detergent solution and fresh water added to wash tub 12 will range from about 0.5 to about 2.5 gallons with a volume of from about 1.0 to 2.0 gallons being preferred. The concentrated chemical solution will typically reside in wash tub 12 and sump 41 of wash tub 12 where it can be pumped by pump 23 and directed into contact with the textile wash load via nozzle 32. The concentrated detergent solution will typically include a mixture of water and detergent in which the detergent is present in an amount ranging from about 0.05% to about 4% or more by weight. The amount of detergent present in a concentrated detergent solution may be greater than about 4 wt %.

In step 110, a predetermined volume of the concentrated chemical solution is pumped from wash tub 12 and sprayed into contact with the textile wash load. The predetermined volume is established, in one method, by operating pump 23 for a predetermined time in order to direct a known volume of liquid from wash tub 12 through nozzle 32 and into wash basket 28 where it contacts the textile wash load. Wash basket 28 is preferably spun relative to stationary wash tub 12 as the concentrated detergent solution is applied to the textile wash load. It is preferred that wash basket 28 is spinning at a lower spin speed than the spin speed of the wash basket during the water extraction steps 140, 180, and 210 etc . . . . During or following step 110, a first airlock detection step 130 and a first water log detection step 120 may occur. If airlock is detected in first airlock detection step 130, then the process advances to step 180 which will be discussed below. If no airlock is detected in step 130, then the process advances to step 140. Likewise, if wash basket drag is detected in first water log detection step 120, the process proceeds to step 330 as shown in FIG. 4 is discussed below. If no water log is detected in step 120, then the process proceeds to step 140.

The processes of this invention may employ either an airlock detection step 130 or a water log detection step 120. Air lock detection step 130 is generally performed in conjunction with load saturation step 110. While detection step 120 may be performed in conjunction with load saturation step 110, in conjunction with water extraction step 120 or both. Alternatively, both detection steps 130 and 120 may be performed in conjunction with step 110. The process only proceeds to step 140 if the one or more condition selected from airlock or water log is not detected. If both detection steps 120 and 130 are performed, then the order of steps 120 and 130 is not crucial.

In step 140 the wash basket spin speed is increased to a high spin speed, relative to the low spin speed of step 110, for a predetermined period of time. Once the predetermined period of time is reached, then the basket spin speed is reduced to a low spin speed and steps 110, 120, 130 and 140 are repeated at least once and preferably two or more times (assuming no water log and/or airlock is detected) in order to completely saturate the textile wash load with the concentrated detergent solution. As indicated above, water log detection step 120 may be performed in conjunction with step 140 in the first instance or it may be performed after water log detection step 120 is performed in conjunction with step 110.

For purposes of this invention, the "low spin speed" is a wash basket rotational rate that is sufficient to allow the top layers of the textile wash load to be wetted by the concentrated detergent solution. In an alternative embodiment, the low spin speed is a rotational rate at which the detergent solution is applied to the textile wash load such that there is no essentially horizontal water extraction from the textile wash load and the concentrated detergent solution moves through the textile wash load as a result of absorption and/or gravity force on the concentrated detergent solution. In yet another embodiment, the low spin speed is a rotational rate at which all of the advantages listed above are achieved. In yet another embodiment, the low spin speed is a rotational rate that applies less than one gravity of centrifugal force on the textile wash load.

For purposes of this invention, a "high spin speed" refers to a wash basket rotational rate that is sufficient to extract some interstitial concentrated detergent solution from the textile wash load. Moreover, the high spin speed causes the wash load to move towards the peripheral wall of wash basket 28 and permits concentrated detergent solution located on the outmost layer of textiles in the wash basket to migrate into the layers of the textile work load closer to the wall of wash basket 28. At a high spin speed, wash basket 28 will preferably apply more than one gravity of centrifugal force on the textile wash load. Alternatively, the wash basket will rotate at a high spin speed about 200 rpm or more. The use of a combination of low and high wash basket spin speeds to improve textile cleaning efficiencies is disclosed in U.S. patent application Ser. No. 11/249,297, filed on Oct. 13, 2005, the specification of which is incorporated herein by reference.

After repeating steps 110-140 a predetermined number of times in step 150, recirculation pump 23 is activated in step 160 and the liquid in wash tub 12 is recirculated for a defined period of time. During step 160, it is preferred that wash basket 28 is stationary. Also during or after step 160, a second air lock detection step 170 is performed. If there is sufficient concentrated chemical solution in wash tub 12, then no air lock will be detected meaning the textile wash load is small enough to become saturated with the initial volume of concentrated detergent solution and the process proceeds to step 330 in FIG. 4. If air lock is detected in second air lock detection step 170, then textile wash load may not have become sufficiently saturated with concentrated detergent solution and the process proceeds to step 180. In step 180, recirculation pump 23 is turned off, and the wash basket spin speed is increased from a low spin speed to a high spin speed for a predetermined period of time in order to attempt to extract concentrated chemical solution from the textile wash load. After the predetermined period of time, the wash basket spinning is halted and a second predetermined volume of fresh water is added to wash tub 12 in step 190. The second predetermined volume of fresh water will typically be a small volume of water that ranges from about 0.25 to about 1 gallon with a preferred volume of above 0.5 gallons—about equal to the fractional volume of liquid directed onto the textile wash load in saturation step 200. The fresh water may be added to wash tub 14 by any available method as described above.

Once step 190 is complete the process advances to step 200 of FIG. 5. In step 200, pump 23 is activated for a period of time sufficient to direct essentially all of the liquid in wash tub 12 onto the textile wash load while wash basket 28 is spinning. Wash tub 28 is preferably allowed to spin at a low spin speed for a second predetermined period of time during step 200 after which the spin speed in accelerated in extraction step 210 to a high spin speed for a third predetermined period of time in order to extract liquid from the textile wash load after which the spin speed is reduced to a slow spin speed in step 220. When wash basket 28 is at the low spin speed in step 220, the recirculation pump is activated and any liquid extracted from the textile wash load that now resides in wash tub 12 is applied to the textile wash load. During or following step 220, a third air lock detection step 230 occurs. If no air lock is detected in third air lock detection step 230, the recirculation pump is turned off and the concentrated detergent solution saturated textile wash load is allowed to rest for a period of time sufficient to enhance the cleanability of the textile wash load. If air lock is detected in third air lock detection step 230, then the process proceeds to step 250 which repeats steps of 190, 200, 210 and 220 at least once and at most twice whether or not air lock detection exists in step 230 after any second iteration of steps 190, 200, 210 and 220.

Referring back to step 120 of FIG. 3, if water log is detected after the initial fraction of saturated detergent solution is applied to the textile wash load, then the process proceeds to drag recovery step 300 of FIG. 4 recirculation pump 23 is activated to direct a predetermined volume of concentrated detergent solution onto the textile wash load while wash basket 28 is spinning at a low spin speed. A second water log detection step 310 is performed following drag recovery step 300. If no water log is detected in second water log detect step 310, then the process proceeds to step 140 of FIG. 3. If water log is detected in step 310, then the number of times drag recovery step 300 has been performed is identified. If a predefined number of iterations "n" of step 300 have been performed, then drag recovery step 300 is repeated. If a predefined number of iterations "n" of step 300 have not been performed, then the process proceeds to spin and recirculation step 330 and wash basket 28 is spun at a low spin speed while a predetermined volume of concentrated detergent solution is applied to the textile wash load. Generally, the number of iterations "n" for steps 300 and 310 will range from 1 to about 5 or more with 2 to 3 iterations being preferred.

Fourth airlock detection step 340 takes place following spin and recirculation step 330. If fourth air lock detection step 340 detects no air lock then the textile wash load is deemed to be sufficiently saturated with concentrated detergent solution and the saturated textile wash load is allowed to rest for a period of time sufficient to improve the cleanability of the textile wash in a normal washing process. If air lock is detected in fourth air lock detection step 340, then spin only step 240 is performed in step 240, wash basket 28 is spun at a low spin speed at least one additional time without liquid recirculation after which the concentrated chemical solution saturated textile wash load is allowed to rest for a period of time sufficient to improve the cleanability of the textile wash in a normal washing process. Once the concentrated chemical solution saturated textile wash load rests for a predetermined period of time, subsequent washing steps are completed including introducing cleaning water into the automatic washer and agitating the textile wash load in the added fresh water, rinsing the textile wash load following the washing step and spinning the textile wash load at a high spin speed in order to extract free water from the textile wash load.

In many of the steps described above require the application of predetermined volumes of liquid or they are performed for a predetermined period of time. Generally, a predetermined volume of recirculating liquid is controlled by actuating recirculation pump 23 for a predetermined and preprogrammed period of time. The predetermined volume then constitutes the pump flow rate multiplied by the time the pump is actuated.

What is claimed is:

1. A method for laundering a textile wash load in a washing apparatus comprising the steps of:

a. loading a textile wash load into a wash basket of the washing apparatus wherein the wash basket is surrounded by a stationary wash tub and is adapted to be rotated relative to the stationary wash tub by a wash basket motor;

b. introducing a volume of concentrated chemical solution into the washing apparatus;

c. applying at least a fraction of the concentrated chemical solution to the textile wash load through operation of a recirculation pump driven by a recirculation pump motor;

d. rotating the wash basket relative to the stationary wash tub by activating the wash basket motor;

e. performing a first air lock detection step to determine whether the recirculation pump is pumping air or foam; and f. performing a first water log detection step to detect whether the wash tub includes excess solution impinging on the wash basket, wherein the first air lock detection step and the first water log detection step are performed based on feedback of a measured operating characteristic of the recirculation pump motor and the wash basket motor respectively.

2. The method of claim 1 wherein the wash basket motor is a motor selected from the group consisting of a non-BPM electrical motor and a BPM motor.

3. The method of claim 1 wherein the recirculation pump motor is selected from the group consisting of an non-BPM electric motor and a BPM electric motor.

4. The method of claim 1 wherein a drag recovery procedure is performed when water log is detected.

5. The method of claim 4 wherein the drag recovery procedure comprises the further steps of:

i. recirculating at least a portion of the a concentrated chemical solution located in the wash tub onto the textile wash load in the wash basket; and ii. performing a second water log detection step.

6. The method of claim 5 wherein an extraction step is performed if the second water log detection step does not detect wash basket drag wherein the extraction step includes the further steps of spinning the wash basket at a high spin speed for a predetermined period of time; and recirculating at least a portion of the concentrated chemical solution in the wash tub onto the textile wash load in the wash basket while the wash basket is spinning at a low spin speed.

7. The method of claim 6 wherein, following the extraction step, the steps of spinning the wash basket at a high spin speed for a first predetermined period of time followed by recirculating a fraction of the concentrated chemical solution onto the textile wash load in the wash basket while the wash basket is spinning at a low spin are repeated a predetermined number of times.

8. The method of claim 7 wherein a second air lock detection step is performed after the predetermined number of times.

9. The method of claim 5 wherein steps (i) and (ii) are repeated a predetermined number of times after which at least a portion of the concentrated chemical solution is directed onto the textile wash load located in the wash basket while the wash basket is spinning at a low spin speed and performing a fourth airlock detection step.

10. The method of claim 5 wherein the steps of performing a drag recovery procedure and performing a water log detection step are repeated if drag is detected during the second water log detection step.

11. The method of claim 10 wherein the drag recovery procedure is repeated a predetermined number of times if drag is detected.

12. The method of claim 11 wherein when the predetermined number of times is reached, then at least a portion of the concentrated chemical solution is directed onto the textile wash load located in the wash basket while the wash basket is spinning at a low spin speed after which another airlock detection step is performed.

13. The method of claim 1 wherein if no air lock is detected by the first air lock detection step, then an extraction step is performed on the textile wash load.

14. The method of claim 13 wherein, following the extraction step, the steps of spinning the wash basket at a high spin speed for a first predetermined period of time followed by recirculating a fraction of the concentrated chemical solution onto the textile wash load in the wash basket while the wash basket is spinning at a low spin are repeated a predetermined number of times.

15. The method of claim 14 wherein a second air lock detection step is performed after the predetermined number of times.

16. The method of claim 15 wherein a third airlock detection steps is performed and, when the third airlock detection step detects airlock, then a second volume of clean water is added to the wash tub and the textile wash load is processed by the further steps comprising:

1. recirculating essentially all of the clean water onto the textile wash load while the wash basket is spinning at a low spin speed;
2. halting the recirculation, increasing the spin speed of the wash basket and allowing the wash basket to spin at a high spin speed;
3. recirculating essentially all of any clean water in the wash tub onto the textile wash load while the wash basket is spinning at a low spin speed; and
4. performing a fourth air lock detection step.

17. The method of claim 16 wherein steps 1-4 are repeated at least once.

18. The method of claim 15 wherein, when no air lock is detected by second air lock detection step, then at least a portion of the concentrated chemical solution is directed onto the textile wash load while the wash basket is spinning at a low spin speed after which another airlock detection step is performed.

19. The method of claim 15 wherein when airlock is detected by the second airlock detection step, the textile wash load undergoes a water extraction step followed by a fresh water refill step.

20. The method of claim 1 wherein when airlock is detected by the first airlock detection step, the textile wash load undergoes a water extraction step followed by a fresh water refill step.

21. The method of claim 20 or 19 wherein the water extraction and fresh water refill steps comprise the further steps of:

spinning the wash basket at a high spin speed for a predetermined period of time;

adding a first volume of fresh water to the wash tub after a second predetermined period of time to form a once diluted concentrated chemical solution;

applying a predetermined volume of the once diluted concentrated chemical solution onto the textile wash load while the wash basket is spinning at a low spin speed;

halting the application of the once diluted concentrated chemical solution;

increasing the spin speed of the wash basket to a high spin speed for a third predetermined period of time and then reducing the wash basket spin speed to a low spin speed;

recirculating once diluted concentrated chemical solution in the wash tub onto the textile wash load while the wash basket is spinning at a low spin speed; and performing another air lock detection step.

22. The method of claim 20 wherein after the fresh water refill step, a first volume of clean water is added to the wash tub after the second predetermined period of time to form a diluted concentrated chemical solution and the textile wash load is processed by the further steps comprising:

recirculating essentially all of the diluted concentrated chemical solution onto the textile wash load while the wash basket is spinning at a low spin speed;

halting the recirculation, increasing the spin speed of the wash basket and allowing the wash basket to spin at a high spin speed;

recirculating essentially all of any diluted concentrated chemical solution in the wash tub onto the textile wash load while the wash basket is spinning at a low spin speed; and performing another air lock detection step.

23. The method of claim 1 including at least two air lock detection steps and at least one water log detection step.

24. The method of claim 23 include a plurality of air lock detection steps and a plurality of water log detection steps.

25. A method for laundering a textile wash load in a washing apparatus comprising the steps of:

a. loading a textile wash load into a wash basket of the washing apparatus wherein the wash basket is surrounded by a stationary wash tub and is adapted to be rotated relative to the stationary wash tub by a motor;

b. introducing a volume of concentrated chemical solution into the washing apparatus;

c. applying at least a fraction of the concentrated chemical solution to the textile wash load through operation of a recirculation pump driven by the motor;

d. rotating the wash basket relative to the stationary wash tub by activating the motor;

e. performing a first air lock detection step to determine whether the recirculation pump is pumping air or foam; and f. performing a first water log detection step to detect whether the wash tub includes excess solution impinging on the wash basket, wherein both the first air lock detection step and the first water log detection step are performed based on feedback of a measured operating characteristic of the motor.

26. The method of claim 25 including at least two air lock detection steps and at least one water log detection step.

* * * * *

UNITED STATES PATENT AND TRADEMARK OFFICE

CERTIFICATE OF CORRECTION

PATENT NO. : 7,934,281 B2
APPLICATION NO. : 11/273207
DATED : May 3, 2011
INVENTOR(S) : Flavio Erasmo Bernardino et al.

It is certified that error appears in the above-identified patent and that said Letters Patent is hereby corrected as shown below:

Col. 9, claim 5, line 3, the phrase "portion of the a concentrated" should read --portion of the concentrated--.

Col. 9, claim 9, line 6, the phrase "fourth airlock" should read --another airlock--.

Col. 10, claim 16, lines 1 and 2, the phrase "a third airlock detection steps" should read --a third airlock detection step--.

Col. 10, claim 18, line 2, the phrase "by second air lock detection step" should read --by the second air lock detection step--.

Signed and Sealed this
Twentieth Day of December, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,934,281 B2
APPLICATION NO. : 11/273207
DATED : May 3, 2011
INVENTOR(S) : Flavio Erasmo Bernardino et al.

It is certified that error appears in the above-identified patent and that said Letters Patent is hereby corrected as shown below:

Column 9, line 27 (claim 5, line 3) the phrase "portion of the a concentrated" should read --portion of the concentrated--.

Column 9, line 54 (claim 9, line 6) the phrase "fourth airlock" should read --another airlock--.

Column 10, lines 15 and 16 (claim 16, lines 1 and 2) the phrase "a third airlock detection steps" should read --a third airlock detection step--.

Column 10, line 33 (claim 18, line 2) the phrase "by second air lock detection step" should read --by the second air lock detection step--.

This certificate supersedes the Certificate of Correction issued December 20, 2011.

Signed and Sealed this
Tenth Day of January, 2012

David J. Kappos

David J. Kappos
*Director of the United States Patent and Trademark Office*